US010485386B2

(12) United States Patent
Melgoza

(10) Patent No.: US 10,485,386 B2
(45) Date of Patent: Nov. 26, 2019

(54) SOAP DISPENSING BOTTLE

(71) Applicant: Cristina Melgoza, Los Angeles, CA (US)

(72) Inventor: Cristina Melgoza, Los Angeles, CA (US)

( * ) Notice: Subject to any disclaimer, the term of this patent is extended or adjusted under 35 U.S.C. 154(b) by 0 days.

(21) Appl. No.: 15/937,734

(22) Filed: Mar. 27, 2018

(65) Prior Publication Data

US 2019/0298114 A1 Oct. 3, 2019

(51) Int. Cl.

| | |
|---|---|
| ***B65D 81/32*** | (2006.01) |
| ***A47K 5/122*** | (2006.01) |
| ***B05B 7/26*** | (2006.01) |
| ***B05C 5/02*** | (2006.01) |
| ***A47K 7/00*** | (2006.01) |

(52) U.S. Cl.

CPC ..... *A47K 5/122* (2013.01); *A47K 7/00* (2013.01); *B05B 7/26* (2013.01); *B05C 5/02* (2013.01)

(58) Field of Classification Search

CPC .... B05C 5/02; B05B 7/26; A47K 7/00; A47K 5/122; B65D 83/0094; B65D 81/3222; B65D 81/3211; B65D 81/3272; B65D 81/3227; B65D 81/3216; B65D 81/3244; A61J 1/2093

USPC ..... 222/129–145.8, 209, 213, 214, 94

See application file for complete search history.

(56) References Cited

U.S. PATENT DOCUMENTS 3,145,879 A 8/1964 Williams
3,731,848 A * 5/1973 Nakanishi ..... B65D 47/12 222/129
3,741,383 A * 6/1973 Wittwer ..... B65D 81/3216 206/219
5,169,030 A * 12/1992 Lewin ..... B65D 35/22 222/107
5,467,877 A * 11/1995 Smith ..... A61J 9/00 215/11.1
5,490,736 A * 2/1996 Haber ..... A61M 35/006 401/132
5,649,643 A 7/1997 Ridgeway
5,692,644 A * 12/1997 Gueret ..... B05B 11/0083 206/222
5,775,591 A 7/1998 Fauci
6,036,005 A * 3/2000 Krause ..... B65D 35/242 206/221
6,073,813 A 6/2000 Tanner
7,028,869 B2 * 4/2006 De Laforcade .... B65D 51/2807 206/219
7,896,180 B2 * 3/2011 Kenney ..... B65D 81/3222 215/11.1

(Continued)

FOREIGN PATENT DOCUMENTS

EP 0412285 3/1990

*Primary Examiner* — Charles Cheyney

(74) *Attorney, Agent, or Firm* — Law Office of Scott C Harris, Inc

(57) ABSTRACT

A personal hygiene water bottle assembly has a bottle, forming a reservoir for water and a soap holder concentrically located within the bottle portion. A manual pump is used to pump soap from the soap holder into the water bottle, to form soapy water in the reservoir. The soapy water can be dispensed through the top spout. The bottle can be disassembled to allow easy cleaning. The bottle can be refilled with water, which can then have soap added to form the soapy water.

10 Claims, 3 Drawing Sheets

(56) References Cited

U.S. PATENT DOCUMENTS

| | | | | |
|---|---|---|---|---|
| 8,025,168 | B2 * | 9/2011 | Bullard | A61J 9/008 215/11.1 |
| 8,403,178 | B2 * | 3/2013 | May | A61J 1/2089 206/219 |
| 8,584,904 | B2 | 11/2013 | Coleman | |
| 9,745,115 | B2 * | 8/2017 | Hall | B65D 81/3211 |
| 2002/0006306 | A1 | 1/2002 | Gregory | |
| 2009/0301032 | A1 * | 12/2009 | Sillince | B65D 81/3222 53/428 |
| 2011/0233118 | A1 * | 9/2011 | Nelson | B05B 11/3001 210/117 |
| 2017/0203947 | A1 * | 7/2017 | James | A47J 31/407 |

* cited by examiner

SOAP DISPENSING BOTTLE

The present application describes a bottle which can dispense soapy water, with a built-in soap dispensing mechanism that dispenses soap into water in the bottle, and can be easily cleaned and changed.

BACKGROUND

Soapy water is often used for cleaning purposes. It is desirable to keep the water clean, and to continuously and regularly change the water in such a bottle.

Dispensing bottles often require replenishment of soapy water, making it difficult to keep cleanliness.

SUMMARY

The present application describes a soap dispensing bottle with a built-in soap dispensing mechanism to dispense a small amount of soap. The soap in the dispensing mechanism can be changed separately from the water in the bottle. An embodiment uses a bulb primer, which is depressed to dispense soap from the internal soap holding and dispensing mechanism, into the inside of the bottle.

BRIEF DESCRIPTION OF THE DRAWINGS in the drawings.

DETAILED DESCRIPTION the embodiments describe a water bottle with an internal soap dispensing mechanism. The water bottle has surfaces that can be squeezed in order to squeeze liquid in the bottle out the top spout. The water bottle also can be easily emptied, cleaned, and re-filled with water. Once re-filled with water, the soap dispensing bulb can be pressed in order to dispense soap into the water. This forms soapy water inside the bottle reservoir, that can be squeezed out through the top spout.

The embodiments which are described herein describe different ways of configuring the bottle. In all these embodiments, the soap dispensing mechanism is substantially concentrically located inside the bottle and dispenses soap using a soap dispensing bulb that is pressed to pump soap out of the soap reservoir into the water reservoir.

Figure 1:
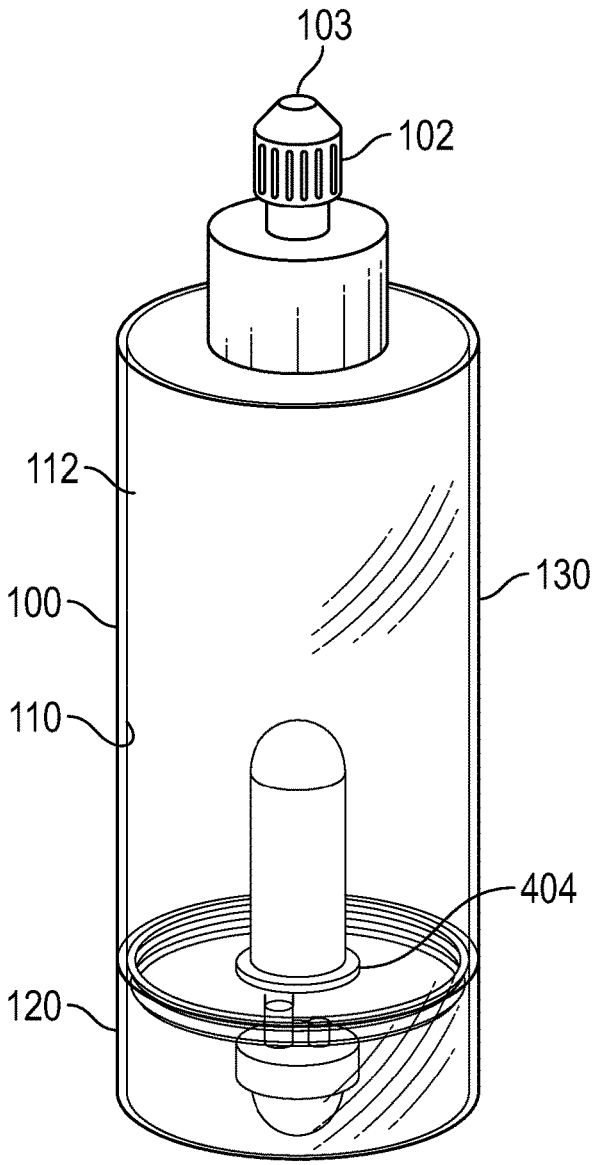
FIG. 1 shows an embodiment of the personal hygiene bottle, with the soap holder concentrically inside the personal hygiene bottle.
Figure 2:
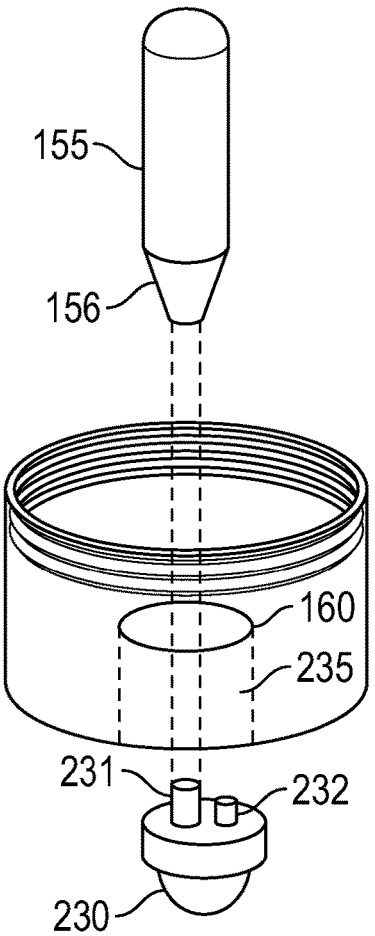
FIG. 2 shows a partly disassembled version of the soap dispensing system.

A first embodiment is shown in FIGS. 1A and 1B. In this embodiment, the bottle 100 has a section in the bottom through which the soap holder is inserted. In one embodiment, this section is a screw on section, which includes gaskets to prevent the water in the bottle from leaking out.

The top of the bottle 102 is a screw on top, which can form a dispenser spout 113, through which the soapy water can be ejected for personal hygiene purposes.

The walls 110 of the bottle 100 are made of deformable plastic material, so that they can be squeezed together to force the water in the bottle out through the spout 103. The walls 110 define a water reservoir 112 which holds water to which soap is mixed as described herein.

In one embodiment, the bottom portion of the bottle 120 twists to screw on and off the bottle. The soap holder 130 is either attached to this bottom portion, or itself screws in an on and off of the bottom portion. The soap holder 130 is attached to a primer bulb 230 which can be pressed to pump soap out of the soap holder into the water reservoir 112 where it mixes with the water that is placed therein.

FIG. 1B illustrates a cutaway and partly disassembled view of the parts including the soap container 130 which includes threads 155 which screw into corresponding screw threads 160 in the bottom portion 120. The soap holder 130 end in a tube connector 156.

The tube connector 156 is connected to a primer bulb 230, which has an inlet 231 and an outlet 232. The primer bulb is located on the bottom part of the bottom of the bottle 120. There is an indented portion shown generally as 235 into which the primer bulb fits. In operation, the primer bulb is fit into the area 235, and the connection 231 is connected to the connection 156 so that depressing the primer bulb forces soap to exit from 232 into the water reservoir 112.

Figure 3:
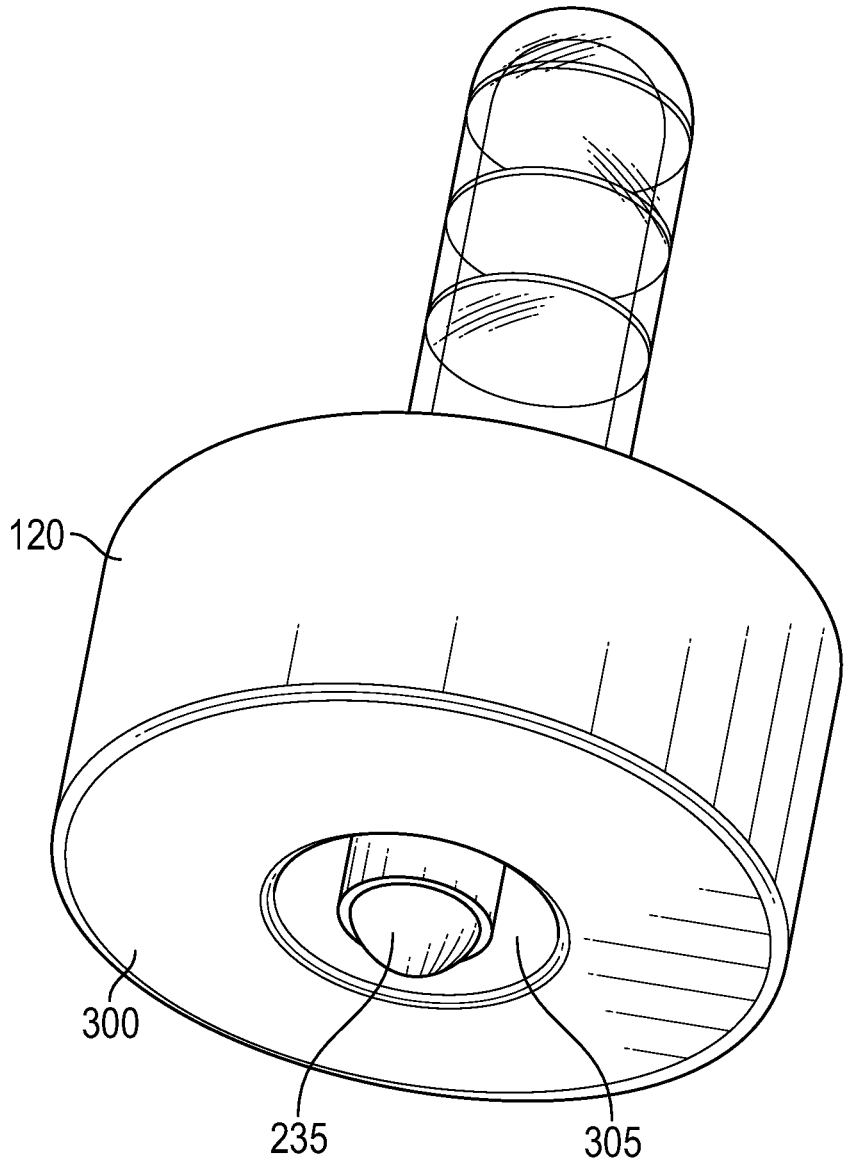
FIG. 3 shows a bottom view of the soap dispensing system.

FIG. 3 illustrates a bottom view of the bottom portion 120 of the bottle, showing that the bottom portion has a flat surface 300 with a concave section 305 into which the primer bulb 230 is located. This provides a pocket for the purge button. In operation, the bottom portion 120 is twisted onto the remainder of the bottle. The bottom portion also comes off for soap refills, at which time the soap container 130 is removed, refilled with soap, and replaced.

In operation, when the primer bulb is depressed, it forces soap from the soap sump into the water reservoir, thus forming soapy water in the reservoir. A primer bulb can be used which has a check valve function, that is only allows the liquid to exhaust in a single direction from the soap holder into the reservoir, and does not allow water to come from the reservoir back into the soap holder. The soapy water is used, and the bottle can be disassembled (removing the top portion 100 from the bottom portion 120) and cleaned. Then, the bottle can be reassembled, and water filled through the cap 102, and then soap pressed out into the reservoir 112, to form soapy water in the reservoir.

Figure 4:
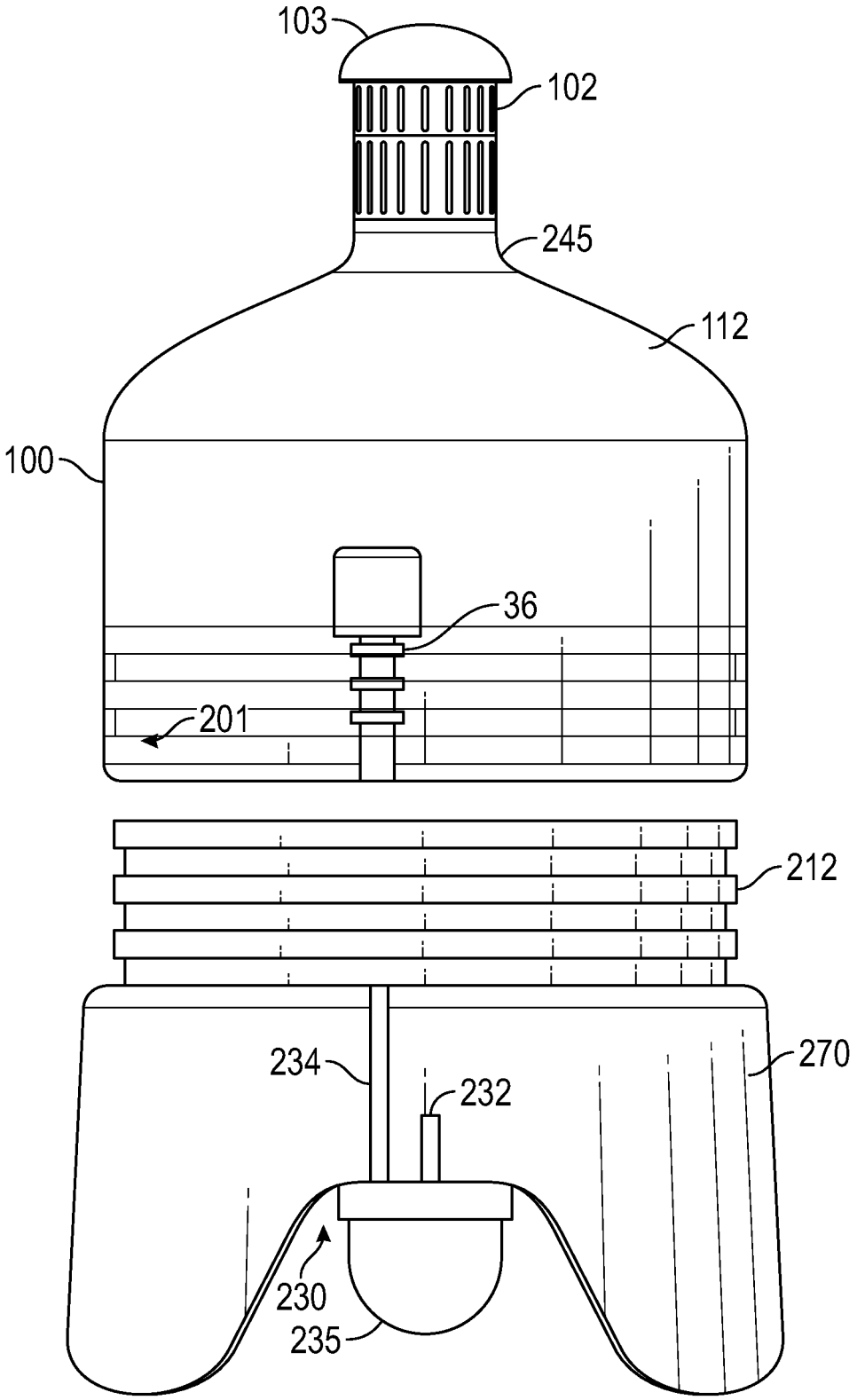
FIG. 4 shows an alternative embodiment

FIG. 4 illustrates a view of an alternative embodiment again where the bottom portion 120 of the bottle screws onto the top portion of the bottle 100. In this embodiment, the bottle is shown as having screw threads 201 at the bottom portion thereof which screws into corresponding screw threads 242 on the bottom portion.

The soap holding portion 236 can be removed when the top 100 and bottom are separated. In this embodiment, the soap holding portion screws on and off the inlet tube 234, which is connects to the purge bulb 230.

The primer 230 is formed of a balloon primer which is depressed to force soap from the reservoir 236 through the pipe 234, and out the outlet pipe 232 to mix with fresh water inside the fresh water reservoir 112. Each time the primer 230 is depressed, it releases a specified metered amount of soap from the soap container 210 into the water reservoir 112 to mix with the water therein. The walls of the water reservoir 112 can be squeezed to expel soapy water from the spout 102, 103.

The spout 102 can also be screwed in by screw threads 245.

The Water bottle can be formed of any deformable or mobile liquid holding material in one preferred embodiment, the water bottle is formed of a deformable thermoplastic polymer, such as #1 PET (polyethylene terephthalate) in one embodiment, a transparent material is used so that the user can easily ascertain whether the water in the reservoir is clean, and when soap has been mixed with the water in the reservoir.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art. For example, other materials and shapes can be used herein. The device is described to create soapy water, but can alternatively be used to create other solutions with materials other than soap in the bottle, e.g., disinfecting solution or the like.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A personal hygiene water bottle assembly, comprising:

a bottle portion, forming a reservoir for water;

an additive holding portion, concentrically located within said bottle portion, forming a reservoir for an additive;

said additive holding portion having an additive dispensing part located within the reservoir for water, and the additive holding portion also including a manual pumping mechanism which is pressed to pump additive from the additive holding portion into the reservoir for water through the additive dispensing part, wherein the manual pumping mechanism includes a purge bulb, which is a substantially spherical bulb of an elastomeric material that is depressed to press additive out of the additive holding portion and into the water reservoir, where the additive dispensing part includes a first tube extending from the purge bulb to the additive holding portion, to draw additive from the additive holding portion, a second tube extending from the purge bulb into the reservoir, and releasing additive which has been drawn from the additive holding portion into the reservoir when the purge bulb is depressed a bottle spout portion, at a top portion of the bottle portion, operative to dispense water with additive from the reservoir, said bottle spout portion being removable using a screw thread.

2. The water bottle assembly as in claim 1, wherein the bottle portion is formed of a deformable thermoplastic polymer material that is substantially clear.

3. The water bottle assembly as in claim 1, wherein the manual pumping mechanism includes a check valve therein, that only allows additive to be exhausted from the additive holding part into the reservoir and does not allow liquid to come from the reservoir into the additive holding part.

4. The water bottle assembly as in claim 3, wherein the purge bulb is located at a lower most portion of the water bottle assembly.

5. The water bottle assembly as in claim 1, wherein the bottle includes a top portion and a removable bottom portion, and the manual pumping mechanism is held within the bottom portion wherein the additive holding part is held concentrically within the top portion by the first tube which extends from the bottom portion into an area inside the top portion, and where the second tube exhausts the additive into an area within the bottom portion.

6. The water bottle assembly as in claim 5, wherein the lower most portion includes a concave portion into which the manual pumping mechanism is held, providing a flat bottom to the lower most portion with a cutout for pumping the manual pumping mechanism.

7. The water bottle assembly as in claim 1, wherein the additive holding portion is removable from the first tube by unscrewing the additive holding portion from the first tube.

8. The bottle assembly as in claim 1, wherein the bottle includes a top portion including the water reservoir, a bottom portion including a additive reservoir, and wherein the top portion and the bottom portion attached to one another by a screw thread connection, wherein both of the bottom portion and the top portion define parts of the reservoir for water, which holds water, therein.

9. The bottle assembly as in claim 1, wherein the additive is soap.

10. The bottle assembly as in claim 9, wherein each press of the primer bulb releases a specified metered amount of soap from the additive reservoir.

* * * * *